US011982513B2

(12) United States Patent
Lee

(10) Patent No.: US 11,982,513 B2
(45) Date of Patent: May 14, 2024

(54) MULTI-ARMAMENT CONTROL SYSTEM USING SINGLE CONTROLLER AND METHOD THEREOF

(71) Applicant: HANWHA AEROSPACE CO., LTD., Changwon-si (KR)

(72) Inventor: Yun Su Lee, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 0 days.

(21) Appl. No.: 18/130,655

(22) Filed: Apr. 4, 2023

(65) Prior Publication Data

US 2023/0314103 A1 Oct. 5, 2023

(30) Foreign Application Priority Data

Apr. 4, 2022 (KR) ..... 10-2022-0041500

(51) Int. Cl.
*F41G 3/22* (2006.01)
*F41G 3/04* (2006.01)

(52) U.S. Cl.
CPC ..... *F41G 3/04* (2013.01); *F41G 3/22* (2013.01)

(58) Field of Classification Search
CPC ..... F41G 3/04; F41G 3/22
USPC ..... 235/411, 412, 413
See application file for complete search history.

(56) References Cited

U.S. PATENT DOCUMENTS

2004/0030570 A1* 2/2004 Solomon ..... G05D 1/0295 700/248
2007/0168117 A1* 7/2007 Howard ..... F41G 7/007 701/425

FOREIGN PATENT DOCUMENTS

JP 2005-147552 A 6/2005
KR 10-1988484 B1 6/2019

* cited by examiner

*Primary Examiner* — Paultep Savusdiphol
(74) *Attorney, Agent, or Firm* — Sughrue Mion, PLLC

(57) ABSTRACT

According to embodiments of the present disclosure, a multi-armament control system is provided. The multi-armament control system includes: platforms including an armament; and an operating vehicle configured to operate the platforms based on a single controller of the operating vehicle. The operating vehicle is further configured to acquire information about a target according to presence or absence of the target, generate a position of a directing point of the target, and share the position of the directing point of the target with the platforms. At least one from among the operating vehicle and the platforms is configured to construct fixed fire nets or variable fire nets of the platforms according to whether the target moves, and by, in part, assigning priority, to each of the platforms based on the target and the firing range of the armament of the platforms.

20 Claims, 10 Drawing Sheets

600

700

MULTI-ARMAMENT CONTROL SYSTEM USING SINGLE CONTROLLER AND METHOD THEREOF

CROSS-REFERENCE TO RELATED APPLICATION

This application is based on and claims priority under 35 U.S.C. § 119 from Korean Patent Application No. 10-2022-0041500, filed on Apr. 4, 2022, in the Korean Intellectual Property Office, the disclosure of which is incorporated by reference herein in its entirety.

BACKGROUND

1. Technical Field

Embodiments of the present disclosure relate to a multi-armament control system using a single controller which constructs a fire net for a fixed target or a drive target by controlling multiple armaments using the single controller and enables a precision strike, and a method thereof.

2. Description of Related Art

An armament refers to a military weapon that reaches and destroys a target or a goal. A store management computer (SMC) enables a precision strike on a target by controlling the payload of an armament, for example, the flight direction and velocity of an armed aerial vehicle. To this end, an armament controller controls and manages the armament by identifying an armed status signal from the armament.

For example, a weapon interface unit (WIU) is also referred to as a remote interface unit (RIU), and serves to manage and control armaments mounted on armed aerial vehicles, such as fighter planes and/or combat helicopters in association with an SMC.

Here, the WIU exchanges various armed status signals, such as MIL-STD-1760 signals and Non MIL-STDE-1760 signals, with an armament, and provides an electrical interface to the SMC via a data communication link, such as digital multiplex data network, critical/discrete signal network, and/or wideband signal network.

Such an armament is controlled by a system that drives a single armament with a single controller. In addition, a system that precisely strikes the entire armaments after inputting coordinates using the single controller is operated.

However, the method of driving a single armament using a single controller requires a number of operators in proportion to the number of operating vehicles.

In addition, in the case where precision strike on the entire armament is conducted by inputting coordinates, the real-time performance and the degrees of freedom for input is reduced and limited.

Therefore, there is a need for a system capable of simultaneously driving and firing armaments of a plurality of vehicles and/or fighter planes with a single control, i.e., a system capable of controlling multiple armaments using a single controller.

Also, there is a need for a system which determines the fire net ranges and order of multiple armaments having different fire nets in response to the real-time location of the target and assigns priority according to the firing range of each armament, thereby increasing the accuracy of hitting the target.

SUMMARY

Aspects of embodiments of the present disclosure include a multi-armament control system using a single controller which can control operations of multiple armaments using the single controller, and a method thereof.

Also, aspects of embodiments of the present disclosure include a multi-armament control system using a single controller which can increase the accuracy of hitting a target by determining fire net ranges and order of multiple armaments having different fire nets in response to a real-time location of a target and assigning priority according to the firing range of each armament, and a method thereof.

In addition, aspects of embodiments of the present disclosure include a multi-armament control system using a single controller which can control a fire net range, a fire net order, and the like to aim at a same directing point of a target when multiple armaments having different fire nets and firing ranges are controlled using the single controller, and a method thereof.

However, aspects of embodiments of the present disclosure are not restricted to those set forth herein. The above and other aspects of embodiments of the present disclosure will become more apparent to one of ordinary skill in the art to which the present disclosure pertains by referencing the detailed description of the present disclosure given below.

According to embodiments of the present disclosure, a multi-armament control system is provided and includes: a plurality of platforms, each of the plurality of platforms including an armament; and an operating vehicle configured to operate the plurality of platforms based on a single controller of the operating vehicle. The operating vehicle is further configured to: acquire information about a target according to presence or absence of the target, generate a position of a directing point of the target, and share the position of the directing point of the target with the plurality of platforms, wherein each of the plurality of platforms is configured to receive the position of the directing point, wherein at least one from among the operating vehicle and the plurality of platforms is configured to construct fixed fire nets or variable fire nets of the plurality of platforms according to whether the target moves, and wherein the at least one from among the operating vehicle and the plurality of platforms is configured to construct the fixed fire nets or the variable fire nets by, in part, assigning priority, to each of the plurality of platforms based on the target and a firing range of the armament of the plurality of platforms.

According to one or more embodiments of the present disclosure, the at least one from among the operating vehicle and the plurality of platforms is configured to construct the variable fire nets of the plurality of platforms by: allocating, to the plurality of platforms, sections in an order from a shortest relative distance from a coordinate point of a center of fire of an armament of the operating vehicle to a longest relative distance from the coordinate point of the center of fire of the armament of the operating vehicle; setting a center point of fire for each section; adjusting a fire net range by setting an offset value based on the coordinate point of the center of fire of the armament of the operating vehicle; and varying the fire net range for each section with time according to a moving speed of the plurality of platforms, a time period, relative positions of the plurality of platforms with respect to the target, and movement of the target.

According to one or more embodiments of the present disclosure, the at least one from among the operating vehicle and the plurality of platforms is configured to: assign the priority to each of the plurality of platforms based on a distance and an armed status of each of the plurality of platforms; allocate the sections to the plurality of platforms based on the priority; and change an order of the sections in real time by taking into account a period of each expected time when a fire net range of the armament of each of the plurality of platforms is varied based on the moving speed of the target and a velocity of the armament of the plurality of platforms.

According to one or more embodiments of the present disclosure, the at least one from among the operating vehicle and the plurality of platforms is configured to: based on a relative position and a distance to the target being out of an effective firing range of the armament of one of the plurality of platforms, not allocating any of the sections to the one of the plurality of platforms; and based on a friendly vehicle existing between the one of the plurality of platforms and the target, not allocating any of the sections to the one of the plurality of platforms.

According to one or more embodiments of the present disclosure, the at least one from among the operating vehicle and the plurality of platforms is configured to construct the fixed fire nets by setting a center point of fire for each of the plurality of platforms and adjust a fire net range by setting an offset value based on a coordinate point of a center of fire of an armament of the operating vehicle.

According to one or more embodiments of the present disclosure, the operating vehicle is further configured to: based on determining that the target is present, obtain a relative distance to the target and check a shootable range by using a distance detector; based on determining that the target is absent, obtain the relative distance by temporarily setting a maximum firing range of an armament of the operating vehicle as the relative distance; and obtain the position of the directing point of the target based on the relative distance.

According to one or more embodiments of the present disclosure, the plurality of platforms are configured to: calculate a distance and a relative position between the armament of the plurality of platforms and the directing point based on posture information and location information about each vehicle equipped with the armament and the directing point received from the operating vehicle; and calculate a target coordinate point of each armament based on a coordinate point preset.

According to one or more embodiments of the present disclosure, the at least one from among the operating vehicle and the plurality of platforms is configured to: determine fire net ranges and a firing order of the armament of the plurality of platforms in real time; assign the priority to the plurality of platforms in an order of a firing range of the armament of the plurality of platforms, based on a distance to the target obtained by the operating vehicle; and based on a friendly vehicle existing on a straight line to the target from one of the plurality of platforms, assign a lower priority or not assigning any priority to the one of the plurality of platforms.

According to embodiments of the present disclosure, a multi-armament control method is provided and includes: controlling, by a single controller of an operating vehicle, armaments of a plurality of platforms; acquiring, by the operating vehicle, information about a target; receiving, by each platform from among the plurality of platforms, the information about the target acquired by the operating vehicle; constructing, by at least one from among the operating vehicle and the plurality of platforms, fire nets of the armaments of the plurality of platforms; and determining, by the at least one from among the operating vehicle and the plurality of platforms, in real time, fire net ranges and a firing order of the armaments based on the fire nets of the armaments by taking into account whether the target moves.

According to one or more embodiments of the present disclosure, the constructing includes: constructing variable fire nets of the armaments by setting a center point of fire for a plurality of sections; and adjusting a fire net range by setting an offset value based on a coordinate point of a center of fire of an armament of the operating vehicle.

According to one or more embodiments of the present disclosure, the constructing the variable fire nets includes varying a fire net range for each section with time according to a moving speed of the plurality of platforms, a time period, relative positions of the plurality of platforms with respect to the target, and movement of the target.

According to one or more embodiments of the present disclosure, multi-armament control method further includes, by the at least one from among the operating vehicle and the plurality of platforms: setting the sections to the plurality of platforms based on measuring a relative position and a distance between the target and each of the plurality of platforms; and removing a section previously set to one of the plurality of platforms or creating an additional section to be set to one of the plurality of platforms, that has not been associated with any of the sections, based on the relative position and the distance between the target and each of the plurality of platforms.

According to one or more embodiments of the present disclosure, the setting of the sections includes: setting section numbers to the sections in an order from one of the sections having a shortest relative distance to the coordinate point of the center of fire of the operating vehicle to another one of the sections having a longest relative distance to the coordinate point of the center of fire of the operating vehicle; assigning a priority to each of the plurality of platforms based on a distance and an armed status of each of the plurality of platforms; allocating the sections to the plurality of platforms based on the priority; and changing in real time the priority and the sections based on a location of the target and a location of each of the plurality of platforms.

According to one or more embodiments of the present disclosure, the assigning the priority includes: checking the relative position and the distance to the target of each of the plurality of platforms; checking an effective firing range of the armaments of the plurality of platforms, not allocating any of the sections to one of the plurality of platforms based on determining that the relative position and the distance of the one of the plurality of platforms to the target are out of an effective firing range of the armament of the one of the plurality of platforms or based on determining that a friendly vehicle exists between the one of the plurality of platforms and the target.

According to one or more embodiments of the present disclosure, the changing includes changing an order of the sections in real time by taking into account a period of each expected time when a fire net range of the armaments of each of the plurality of platforms is varied based on a moving speed of the target and a velocity of the armaments of the plurality of platforms.

According to one or more embodiments of the present disclosure, the constructing includes: constructing fixed fire nets of the armaments by adjusting a center point of fire and a fire net range for each of the plurality of platforms by setting an offset value based on a coordinate point of a center of fire of an armament of the operating vehicle.

According to one or more embodiments of the present disclosure, the acquiring the information about the target includes: acquiring posture/location information about the operating vehicle and armament position information; determining presence or absence of the target; acquiring a relative distance to the target according to the presence or absence of the target; generating a position of a directing point based on the relative distance; and sharing at least the position of the directing point with the plurality of platforms.

According to one or more embodiments of the present disclosure, the acquiring the information about the target further includes: based on determining that the target is present, obtaining a relative distance to the target and checking a shootable range by using a distance detector; or based on determining that the target is absent, obtaining the relative distance by temporarily setting a maximum firing range of an armament of the operating vehicle as the relative distance.

According to one or more embodiments of the present disclosure, the constructing the fire nets includes: receiving a position of a directing point from the operating vehicle; acquiring posture information and location information about each of the plurality of platforms; calculating a distance and a relative position to the directing point; and calculating a target coordinate point of each of the armaments based on a coordinate point preset.

According to one or more embodiments of the present disclosure, the determining includes: assigning a priority to each of the plurality of platforms in an order of a firing range of the armaments of the plurality of platforms; and based on a friendly vehicle existing on a straight line to the target from one of the plurality of platforms, assigning a lower priority to the one of the plurality of platforms.

It should be noted that effects of embodiments of the present disclosure are not limited to those described above, and other effects of embodiments of the present disclosure will be apparent from the following description.

BRIEF DESCRIPTION OF THE DRAWINGS

The above and other aspects and features of embodiments of the present disclosure will become more apparent by describing in detail non-limiting example embodiments of the present disclosure with reference to the attached drawings, in which.

DETAILED DESCRIPTION

Figure 1A:
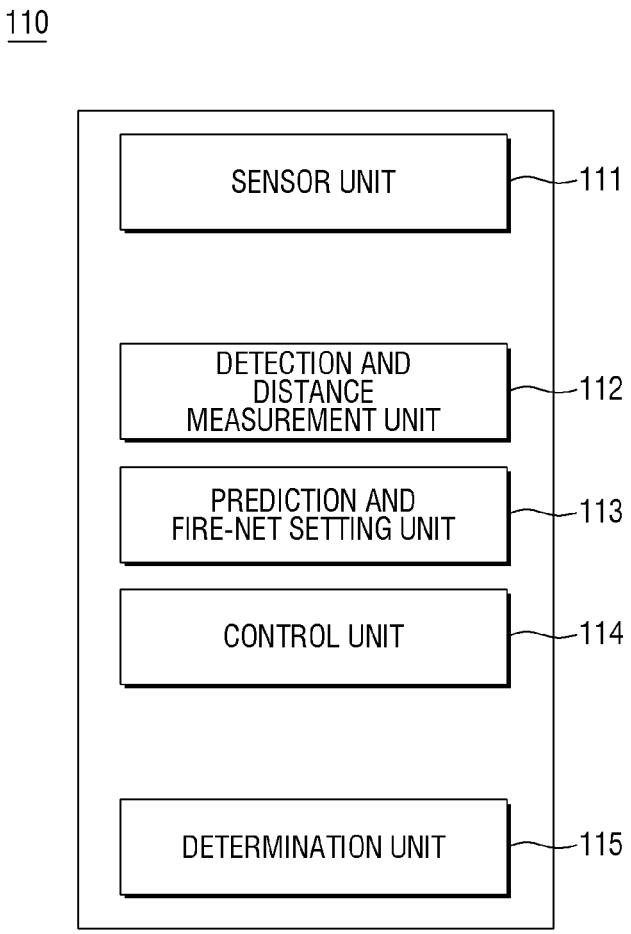
FIG. 1A is a block diagram illustrating a device for a multi-armament operating method using a single controller according to an embodiment of the present disclosure.

Advantages and features of embodiments of the present disclosure will become apparent from the descriptions of non-limiting example embodiments described below with reference to the accompanying drawings. However, the present disclosure is not limited to the example embodiments described in the present disclosure and embodiments of the present disclosure may be implemented in various ways. The non-limiting example embodiments are described for making the present disclosure thorough and for fully conveying the scope of the present disclosure to those skilled in the art. Like reference numerals denote like elements throughout the descriptions.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Terms used herein are for describing examples embodiments rather than limiting the present disclosure. As used herein, the singular forms are intended to include plural forms as well, unless the context clearly indicates otherwise. Throughout this specification, the word "comprise" and variations such as "comprises" and "comprising," and the word "include" and variations such as "includes" and "including," will be understood to imply the inclusion of stated elements but not the exclusion of any other elements.

Hereinafter, non-limiting example embodiments of the present disclosure will be described in detail with reference to the accompanying drawings.

Hereinafter, a multi-armament control method using a single controller according to embodiments of the present disclosure will be described with reference to the attached drawings.

FIG. 1A is a block diagram illustrating a device for a multi-armament operating method using a single controller according to an embodiment of the present disclosure.

Referring to FIG. 1A, in order to implement multi-armament control using a single controller according to an embodiment of the present disclosure, an operating vehicle 110 operated by an operator may include a single controller, a sensor unit 111, a detection and distance measurement unit 112, a prediction and fire-net setting unit 113, a control unit 114, and a determination unit 115. Specifically, the operating vehicle 110 may include the single controller for control, the sensor unit 111 configured to detect a hit of a target by a fire net, the detection and distance measurement unit 112 configured to detect a target and measure a distance to the target (e.g., may include a distance detector), the prediction and fire net setting unit 113 configured to predict movement according to movement of the target and set a fire net of surrounding armaments (e.g., of vehicles or configurations provided in a platform), the control unit 114 configured to control multiple armaments according to a single operation of the operating vehicle 110, and the determination unit 115 configured to recognize the hit of the target detected by the sensor unit 111.

These components are provided for a single controller and may be changed or modified without limitation.

According to embodiments of the present disclosure, the single controller may be configured to be controlled by a single user to performs its functions. For example, the single controller may include at least one input device (or inputter) that may include, for example, buttons, switches touch screens, etc., for receiving an input from the user for controlling one or more of the sensor unit 11, the detection and distance measurement unit 112, the prediction and fire net setting unit 113, the control unit 114, and the determination unit 115, and/or for controlling the platforms 120.

According to embodiments of the present disclosure, the "single controller" may mean a single controller provided in an operating vehicle to drive an armed device, and the single controller of the operating vehicle may be configured to control multiple platforms.

According to embodiments of the present disclosure, the detection and distance measurement unit 111, the prediction and fire net setting unit 113, the control unit 114, and the determination unit 115 may each be implemented by the same or different at least one processor and memory storing computer instructions. The computer instructions, when executed by the at least one processor, may be configured to cause the detection and distance measurement unit 111, the prediction and fire net setting unit 113, the control unit 114, and/or the determination unit 115 to perform their respective functions.

Figure 1B:
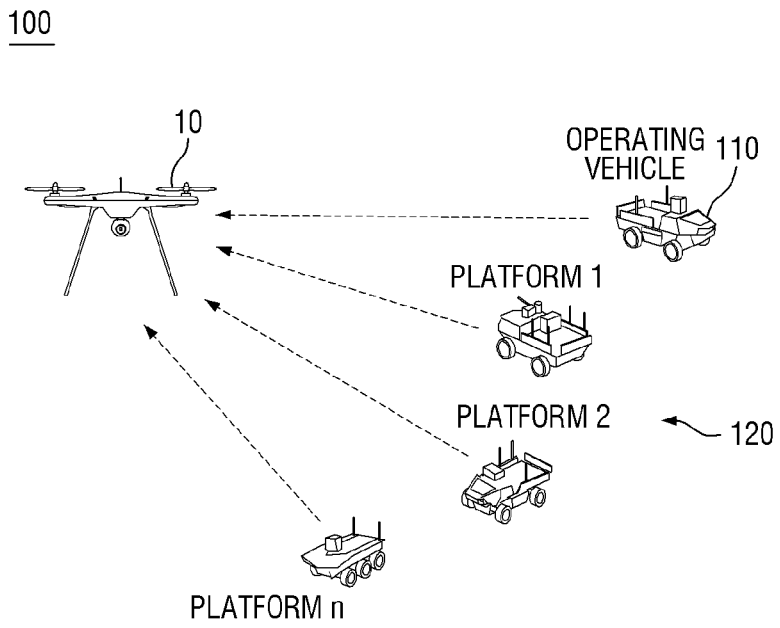
FIG. 1B is a schematic diagram of a multi-armament control system using a single controller according to an embodiment of the present disclosure.

FIG. 1B is a schematic diagram of a multi-armament control system 100 using a single controller according to an embodiment of the present disclosure.

Referring to FIG. 1B, the multi-armament control system 100 according to an embodiment of the present disclosure may include a plurality of platforms 120 equipped with an armament and an operating vehicle 110 configured to operate the plurality of platforms 120 through a single controller. According to embodiments of the present disclosure, each of the platforms 120 may be a static platform or may be vehicles that are movable. According to embodiments of the present disclosure, each of the platforms 120 may be unmanned (e.g., an unmanned vehicle).

In addition, the operating vehicle 110 may acquire information on a target 10 according to the presence or absence of the target 10. In addition, the operating vehicle 110 may generate a directing point position of the target 10 and share the acquired information with the plurality of the platforms 120. Each of the plurality of platforms 120 may receive the shared directing point position and be assigned a priority according to the target 10 and the firing range of the armament of the plurality of platforms 120. The plurality of platforms 120 may constitute a fixed fire net or a variable fire net depending on whether the target 10 moves.

For constructing the fire nets of the armaments, posture information and location information about each platform 120 equipped with the armament and the directing point received from the operating vehicle 110 may be used. For example, in order to construct the fire nets of the armaments, distance and relative position between each armament and the directing point may be calculated. In addition, a target coordinate point of each armament may be calculated by applying coordinate points for constructing the fire net through the calculated distance and relative position between each armament and the directing point, and the fire nets of the armaments that interwork with the operating vehicle 110 may be constructed.

The fire net ranges and firing order of the armaments are reflected in real time, but the fire net ranges and firing order may be varied according to whether the target 10 moves. However, as will be described below, irrespective of a fixed fire net or a variable fire net, priority may be assigned according to the firing range of the armament equipped in each of the plurality of platforms 120 based on the distance to the target 10 obtained by the operating vehicle 110. In addition, when a friendly vehicle exists on a straight line from one of the platforms 120 among the plurality of platforms 120 to the target 10, and therefore may interfere with the one of the platforms 120 hitting the target with armament, the one of the platforms 120 may be given a lower priority or excluded.

The operating vehicle 110 and the plurality of platforms 120 may construct a fixed fire net or a variable fire net according to whether the target 10 moves. For example, when the target 10 is fixed, the operating vehicle 110 and the plurality of platforms 120 may construct a fixed fire net. On the other hand, when the target 10 moves, the operating vehicle 110 and the plurality of platforms 120 may construct a variable fire net.

First, as the target 10 is fixed in position, the operating vehicle 110 and the plurality of platforms 120 may construct a fixed fire net toward the target 10. Specifically, the fixed fire net of the operating vehicle 110 and the plurality of platforms 120 may be constructed by adjusting the fire net ranges. The fire net ranges may be adjusted by setting a center point of fire for each platform 120 before the initial maneuver and setting an offset value from a coordinate point of the firing point of the armament equipped in the operating vehicle 110 (refer to FIG. 6).

On the other hand, when the target 10 moves, a distance between each of the operating vehicle 110 and the plurality of platforms 120 and the target 10 may vary. Therefore, a variable fire net is constructed according to the relative distance to the target 10 and the firing range of the armament of each of the operating vehicle 110 and the plurality of platforms 120, which will be described below (refer to FIGS. 7 to 9).

In order to construct variable fire nets of the operating vehicle 110 and the plurality of platforms 120, sections may be set for the plurality of platforms 120 in the order from the shortest relative distance to the coordinate point of the center of fire to the longest relative distance. Here, a section may be a separate designation set for a plurality of platforms (first platform, second platform, n platform), and a section may mean a platform numbered in order of increasing relative distance from the center of fire of the operational device (device driven by an operator) based on the center of fire. Thus, the sections may be set in such a way that the section with the closest relative distance to the coordinate point of the center of fire is the first section, and the sections are numbered in order of increasing relative distance.

After setting the sections, a center point of fire for each section may be set before the initial maneuver. An offset value of the center point of fire set for each section may be set based on the coordinate point of the center of fire of the armament equipped in the operating vehicle 110 to adjust the fire net range. The fire net range for each section may vary with time according to the moving speed, the expected time, and the relative position of the platform 120 equipped with the armament according to the movement of the target 10.

Here, the section may be set by giving priority to each platform 120 based on the distance to the target 10 and the armed status of the platform 120 and assigning a number to each platform 120 in ascending order from the highest priority to the lowest priority. In addition, as the fire net range of each platform 120 varies based on the moving speed of the target 10 and the velocity of the armament of the platform 120, the order of the sections may be changed in real time by taking into account the period of each expected time.

In addition, when the relative position and distance to the target 10 are out of the effective firing range of the armament equipped in the platform 120, the allocation of the section may be excluded. Also, when a friendly vehicle exists between the platform 120 and the target 10, the allocation of the section may be excluded.

The operating vehicle 110 checks the presence or absence of the target 10 and shares information about the target 10 with the plurality of platforms 120. The operating vehicle 110 checks the presence or absence of the target 10 in order to share the information about the target 10. At this time, the target 10 may or may not exist. Depending on the presence or absence of the target 10, the acquisition of the relative distance may vary.

First, when the target 10 exists, the relative distance to the target 10 may be acquired and a shootable range may be checked through the detection and distance measurement unit 112 provided in the operating vehicle 110. On the contrary, when the target 10 does not exist, the operating vehicle 110 may set the maximum firing range of the armament of the operating vehicle 110 as a temporary range to obtain a relative distance and may check a shootable range.

Figure 2:
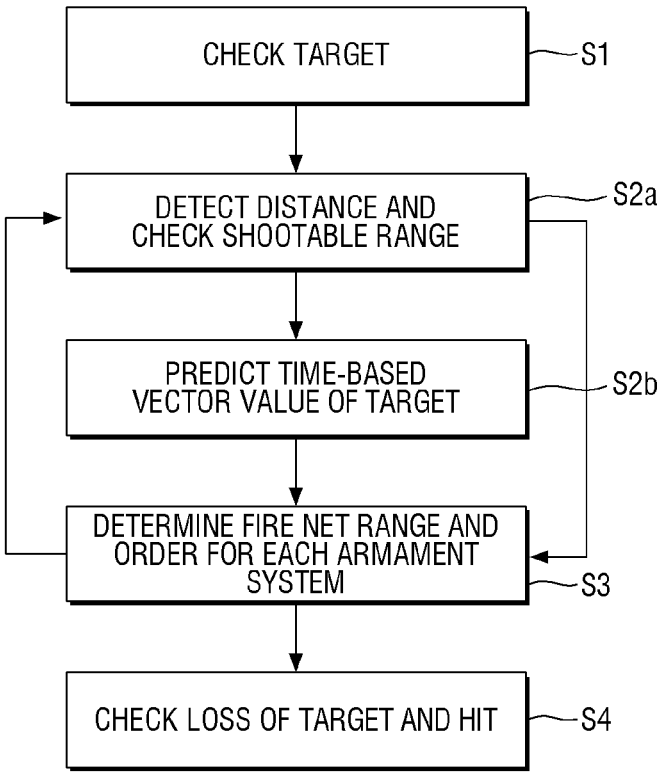
FIG. 2 is an overall flowchart of a multi-armament control method using a single controller according to an embodiment of the present disclosure.
Figure 3:
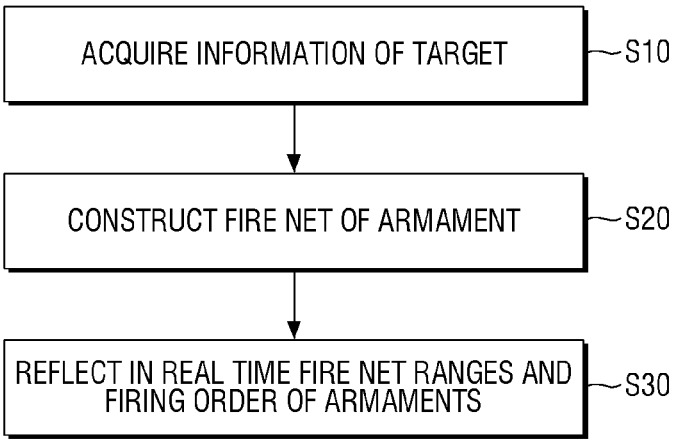
FIG. 3 is a schematic flowchart of a multi-armament control method using a single controller according to an embodiment of the present disclosure.

FIG. 2 is an overall flowchart of a multi-armament control method using a single controller according to an embodiment of the present disclosure. FIG. 3 is a schematic flowchart of a multi-armament control method using a single controller according to an embodiment of the present disclosure.

Referring to FIGS. 2 and 3, a multi-armament control method using a single controller according to an embodiment of the present disclosure may control multiple armaments with a single controller. In addition, in the multi-armament control method using a single controller, the fire net range of each armament varies according to a muzzle velocity of each armament, the order of the armaments (or the order of sections) may be changed according to a moving speed of a target 10, the movement of the target 10, the status and time interval of the platforms 120, and the removal or addition of an armament (or section) may be controlled according to the firing range of the armament.

Specifically, the multi-armament control method using a single controller according to an embodiment of the present disclosure may include checking (or confirming) a target (step S1). For example, the confirming the target may include acquiring information about the target 10 (step S10). The multi-armament control method may further include detecting a distance to the target 10 and checking a shootable range (step S2*a*), predicting a time-based vector value of the target 10 in the case of the target 10 being a moving target (step S2*b*), constructing a fire net of armaments (step S20), and determining (also referred to as reflecting), in real time, fire net ranges and firing order of the armaments (step S3 and step S30). In addition, loss of the target may be checked and firing may be commenced (step S4).

First, an operator in an operating vehicle 110 may control armaments equipped in a plurality of platforms 120 (collectively referred to as both stationary platforms and moving platforms) using a single controller of the operating vehicle 110 and may confirm the target, including acquiring information about the target 10 through the operating vehicle 110 (step S1 and step S10). The operating vehicle 110 may confirm the target 10 (step S1) and check information such as a distance to the target, a shootable range, and the like.

After confirming the target 10 and acquiring the information about the target 10, the operating vehicle 110 may share the acquired information with the plurality of platforms 120. The plurality of platforms 120 may each receive the information about the target 10 acquired by the operating vehicle 110 and construct a fire net for each armament (step S20).

The operating vehicle 110 may detect the distance between each of the operating vehicle 110 and the platforms 120 and the target 10 and check the shootable range (step S2*a*). Also, the operating vehicle 110 may predict a time-based movement value (vector value) of the target 10 by taking into account whether the target 10 moves (step S2*b*) and construct the fire net for each armament.

According to the fire nets of the armaments, the fire net ranges and firing order of the armaments that interwork with the operating vehicle 110 may be determined (or reflected) in real time (step S30).

Through the above flow, the multiple armaments are controlled with a single controller of the operating vehicle 110 to check loss of the target and hit of the target 10 (step S4).

Hereinafter, the above operations will be described in greater detail with reference to the drawings.

Figure 4:
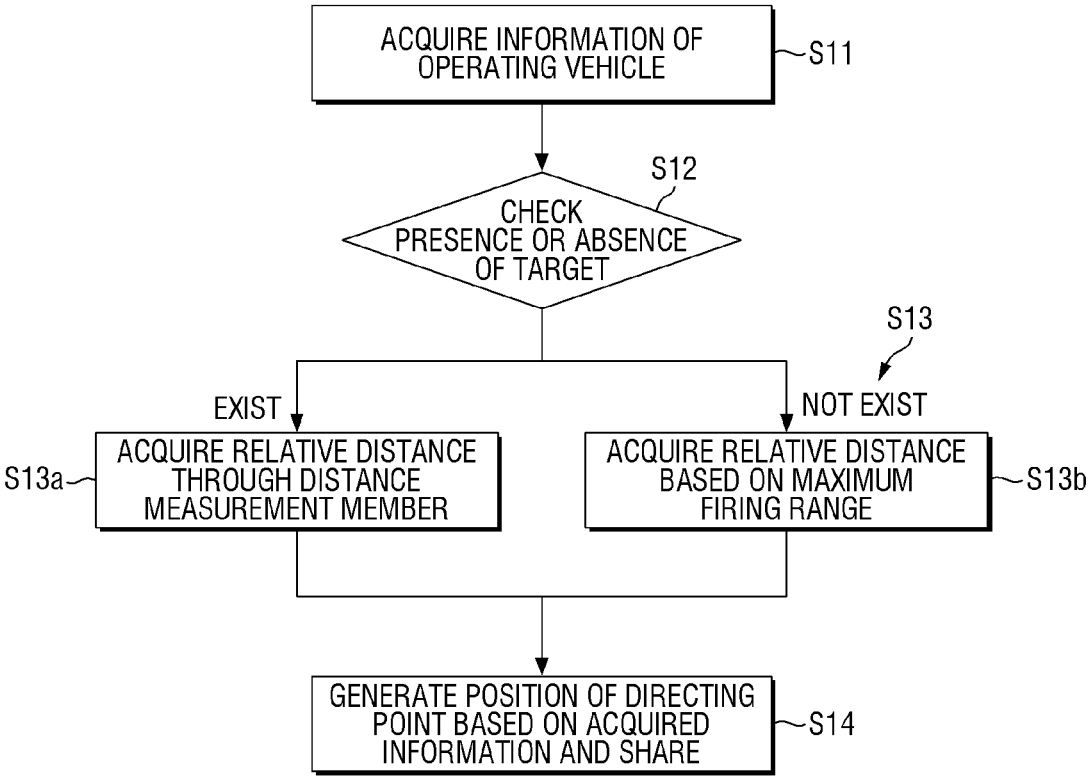
FIG. 4 is a schematic flowchart of a process in which an operating vehicle acquires information about a target and shares the information with a plurality of platforms in a multi-armament control method using a single controller according to an embodiment of the present disclosure.

FIG. 4 is a schematic flowchart of a process in which the operating vehicle 110 acquires the information about target 10 and shares the information with the plurality of platforms 120 in a multi-armament control method using a single controller according to an embodiment of the present disclosure.

Referring to FIG. 4, in the acquiring of the information about the target 10 (step S10) according to an embodiment of the present disclosure, the information about the target 10 may be acquired through the operating vehicle 110.

Specifically, the acquiring of the information about the target 10 (step S10) may include acquiring information about the operating vehicle 110 and information about the armaments, including information about the armaments of the multiple platforms (step S11), checking the presence or absence of the target 10 (step S12), obtaining a relative distance (step S13), and generating a position of directing point that corresponds to the target 10 and sharing acquired information including some or all of the information described above with the plurality of platforms 120 (step S14).

Each of the platforms 120 equipped with the armament may be operated (e.g., driven) by the operator via the operating vehicle 110. The operating vehicle 110 may acquire a posture, navigation information, location information, and armament driving information about the operating vehicle 110 together with various information of other armaments, such as postures, orientations, position information, and the like (step S11).

As described above, after the information about the operating vehicle 110 and the information about multiple platforms 120 equipped with the armament that can be controlled by the operating vehicle 110 are acquired, the operating vehicle 110 may check the presence or absence of the target 10 (step S12).

After checking the presence or absence of the target 10, the operating vehicle 110 may acquire a relative distance to the target 10 and check a shootable range (step S13). When the operating vehicle 110 checks the presence or absence of the target 10, the target 10 may or may not exist.

For example, when it is confirmed that the target 10 exists, the relative distance to the target may be acquired and the shootable range may be checked using the detection and distance measurement unit 112 (that may include, for example, a laser distance detector) in the step of acquiring the relative distance (step S13*a*).

On the contrary, when it is confirmed that the target 10 does not exist, the maximum firing range of the armament of the operating vehicle 110 may be temporarily set as the relative distance to the target 10 in the step of acquiring of the relative distance (step S13*b*). For example, in the case of K3 armament having a maximum firing range of 3.6 km, the maximum firing range of 3.6 km may be temporarily set as the relative distance to the target 10.

After the relative distance to the target 10 is acquired according to the presence or absence of the target 10 as described above, the operating device 110 generates a directing point position that corresponds to the target 10, based on the acquired information. In addition, the operating vehicle 110 may share the acquired information, such as the directing point position that corresponds to the target 10, with the plurality of platforms 120 operated by the single controller (step S14).

The operating vehicle 110 may acquire the information about the target 10 in real time by repeating the above steps.

Figure 5:
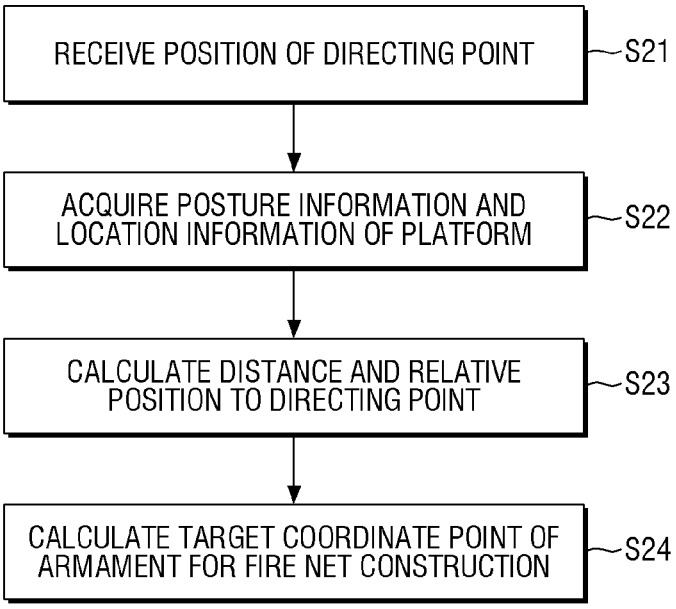
FIG. 5 is a schematic flowchart of construction of fire nets of multiple armaments according to information sharing of an operating vehicle in a multi-armament control method using a single controller according to an embodiment of the present disclosure.

FIG. 5 is a schematic flowchart of construction of fire nets of multiple armaments according to the information sharing of the operating vehicle 110 in a multi-armament control method using a single controller according to an embodiment of the present disclosure.

Referring to FIG. 5 in conjunction with FIGS. 3 and 4, as described above, the operating vehicle 110 may check the information about the target 10 and share the information with other platforms 120 equipped with the armament.

The platforms 120 equipped with the armament that have received the information shared by the operating vehicle 110 construct a fire net of the equipped armaments (step S20).

The constructing of the fire nets of the armaments that interwork with the operating vehicle 110 (step S20) may include receiving the directing point position (step S21), acquiring posture information and location information about the platforms 120 (step S22), calculating the distance to the directing point position and calculating the relative distance of the platform itself from the operating vehicle. to the directing point (step S23), and calculating a target coordinate point (step S24).

The platforms 120 equipped with the armament driven by the single controller may receive a position of the directing point from the operating vehicle 110 (step S21).

Each platform 120 from among the platforms 120 that have received the position of the directing point may acquire posture information and position information about the armament of the platform 120 (step S22). Also, after each platform 120 acquires the posture information and position information about the armament equipped therein, the platforms 120 may transmit the acquired information (e.g., the posture information and position information about the armament of the respective platform 120) to the operating vehicle 110.

The platforms 120 driven by the single controller may each calculate the distance and relative position of, for example, the respective platform 120 (e.g., the armament equipped therein) to the directing point through the information transmitted from the operating vehicle 110 and their own acquired information (step S23).

The armament equipped in each platform 120 may have a different distance to the target 10 according to the position of the platform 120, and the firing range, firing velocity, and muzzle velocity of the armament may be different from one platform (e.g., vehicle) to another. Accordingly, a target coordinate point of the armament may be calculated for constructing the fire net by using a coordinate point preset for each armament and a set constant of the armament (step S24). For example, each platform 120 may calculate the target coordinate point of its own armament.

In addition, when the fire net for each armament is constructed, the fire net range or the relative distance to the target 10 may vary according to whether the target 10 moves, the movement of the platform 120, and the armament. Accordingly, the construction of the fire net may vary in various ways, which will be described in detail below.

After the fire nets of the armaments are constructed, the fire net ranges and firing order of the armaments may be determined (e.g., reflected) in real time. For example, the operating vehicle 110 may give priority to the platforms 120 according to the firing range of the armament equipped in each platform 120 based on the acquired distance to the target 10. Here, when a friendly vehicle exists on a straight line from one of the platforms 120 among the plurality of platforms 120 to the target 10, and therefore may interfere with the one of the platforms 120 hitting the target 10 with armament, the one of the platforms 120 may be given a lower priority.

Hereinafter, construction of a fire net for each platform 120 will be described in greater detail with reference to the drawings.

Figure 6:
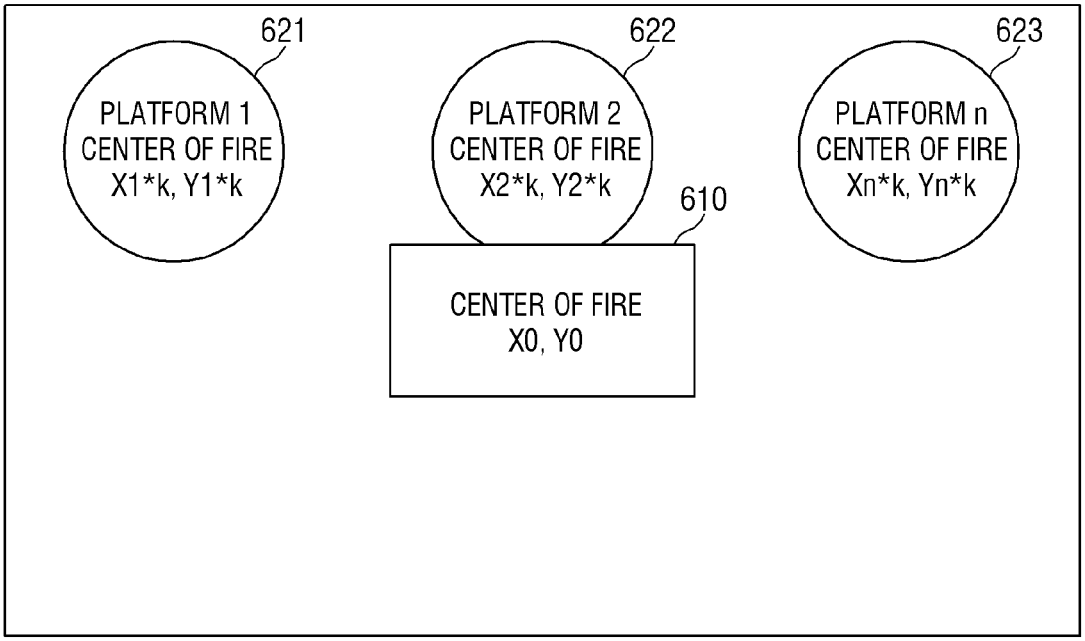
FIG. 6 is a diagram for describing construction of a fixed fire net and a precision strike method in a multi-armament control method using a single controller according to an embodiment of the present disclosure.

FIG. 6 is a diagram 600 for describing construction of a fixed fire net and a precision strike method in a multi-armament control method using a single controller according to an embodiment of the present disclosure.

Referring to FIG. 6, fixed fire nets of the armaments according to an embodiment of the present disclosure may be constructed and a precision strike for the fire nets may be conducted.

Specifically, the plurality of platforms 120 receiving the information about the target 10 acquired by the operating vehicle 110 may be set the center point of fire for each platform 120 before the initial maneuver. The fire net range may be adjusted by setting an offset value between the operating vehicle 110 and each platform 120 based on a coordinate point of the center of fire of the armament equipped in the operating vehicle 110 operated by the operator. For example, based on coordinates (X0, Y0) of the center of fire 610 of the operating vehicle 110, a wider fire net may be constructed by setting offset values as X1=−10 and Y1=−10 for coordinates of the center of fire of a "PLATFORM 1" among the platforms 120. In addition, if X1=0 and Y1=0 are input as the coordinates of the center of fire of the "PLATFORM 1" from among the platforms 120, it may be possible to conduct a precision strike. Furthermore, the operating vehicle 110 may variably construct the area of the fire net of each platform 120 based on a constant k for the center point of fire of each platform 120. For example, the operating vehicle 110 may obtain the constant k based on an operator of the operating vehicle 110 setting the constant k via an input device (e.g., a button, switch, touchscreen, etc.) of the operating vehicle 110, but embodiments of the present disclosure are not limited thereto.

According to embodiments of the present disclosure, with reference to FIG. 6, coordinate points for the center of fire of sections (e.g., "SECTION 1," "SECTION 2," . . . , "SECTION n") may be set by, for example, the operating vehicle 110, based on respective sets of offset values (e.g., a set of offset values X1, Y1; a set of offset values X2, Y2; and a set of offset values Xn, Yn) and based on each of the offset values being multiplied by the constant k. Accordingly, for example, a center of fire 611 of "SECTION 1," a center of fire 612 of "SECTION 2," and a center of fire 613 of "SECTION n" may be obtained.

According to embodiments of the present disclosure, the operating vehicle 110 and/or the platforms 120 may obtain/set coordinate points of the center of fire for each of the platforms 120. For example, the sections (and their respective coordinate points of center of fire) may be set to respective ones of the platforms 120 by the operating vehicle 10 or the platforms 120. For example, the sections may be set to the respective ones of the platforms 120 based on priority, as described in the present disclosure. With reference to FIG. 6, the platforms 120 may include a "PLATFORM 1" that has a center of fire 621, a "PLATFORM 2" that has a center of fire 622, and a "PLATFORM n" that has a center of fire 623. As an example, the center of fire 612 of "SECTION 2" may be set to be the center of fire 621 of "PLATFORM 1, and the center of fire 611 of "SECTION 1" may be set to be the center of fire 622 of "PLATFORM 2." With reference to FIG. 6, the center of fire of a platform other than "SECTION 1," "SECTION 2," and "SECTION n" may be set as the center of fire 623 of "PLATFORM n."

Figure 7:
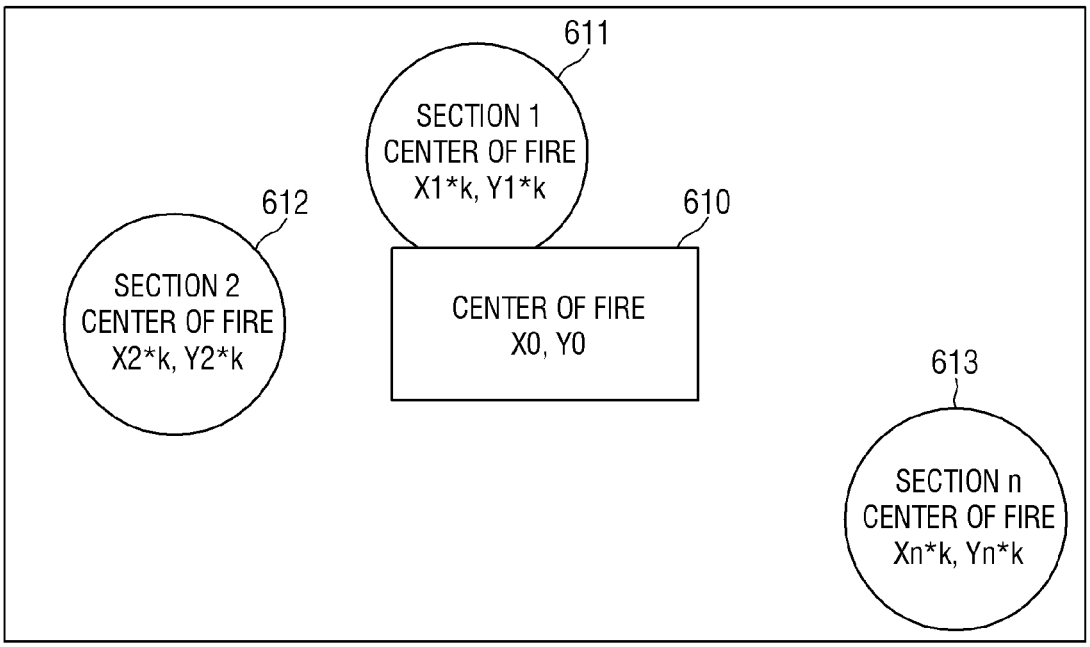
FIG. 7 is a diagram for describing construction of a fixed fire net and a precision strike method in a multi-armament control method using a single controller according to an embodiment of the present disclosure.
Figure 8:
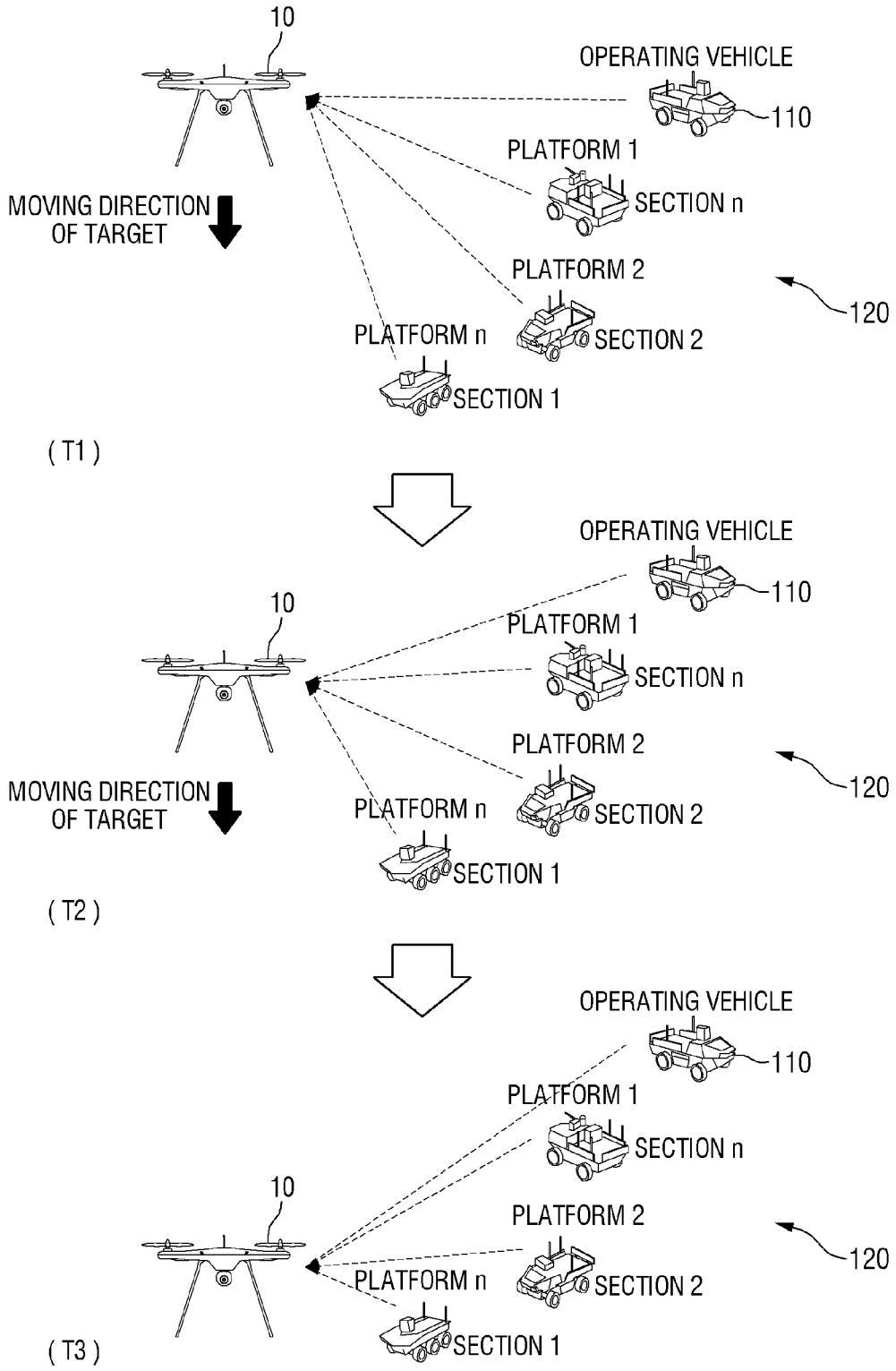
FIG. 8 is a diagram illustrating variation of a fire net distance according to a moving target in a multi-armament control method using a single controller according to an embodiment of the present disclosure.
Figure 9:
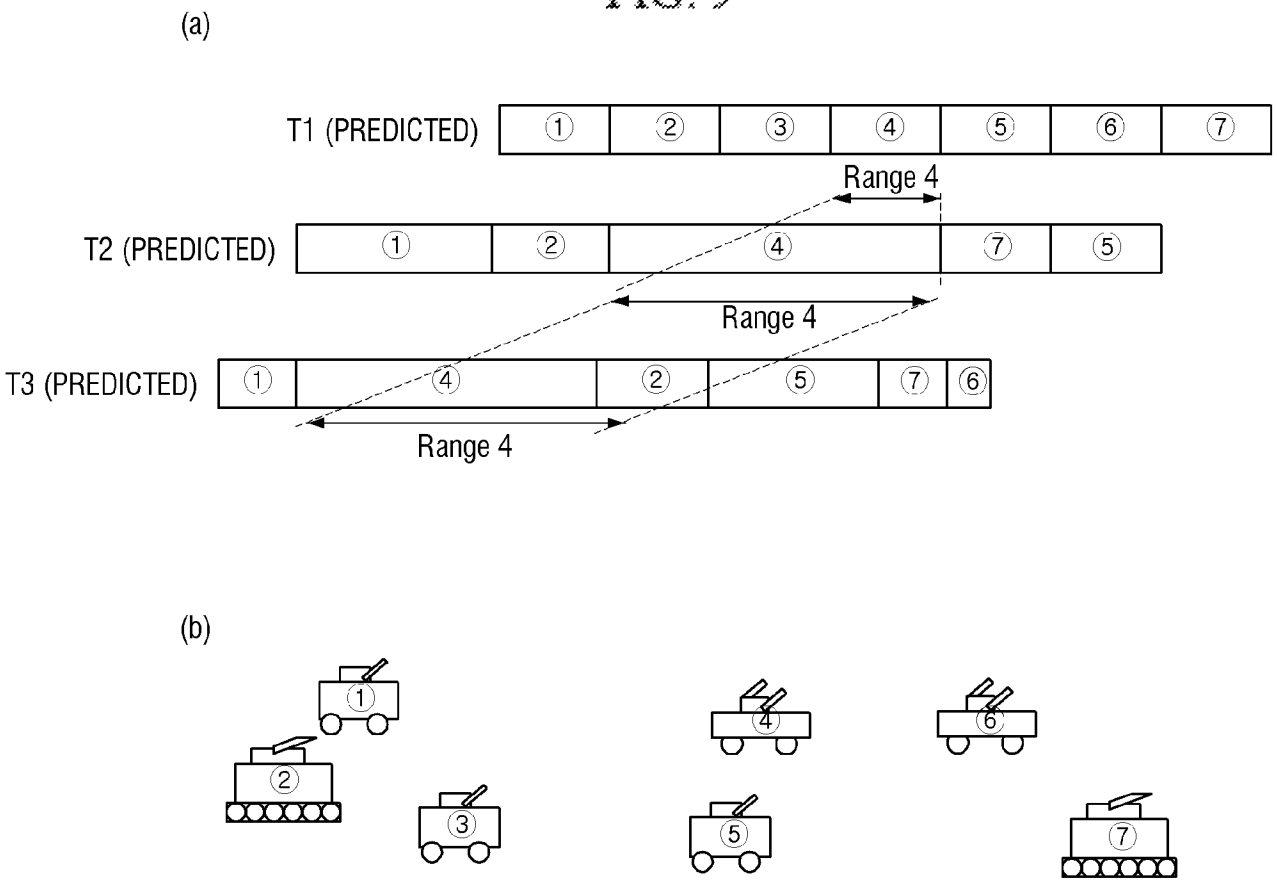
FIG. 9 is a diagram illustrating a change in a firing net range and a change in an order of sections according to a moving target in a multi-armament control method using a single controller according to an embodiment of the present disclosure.
Figure 10:
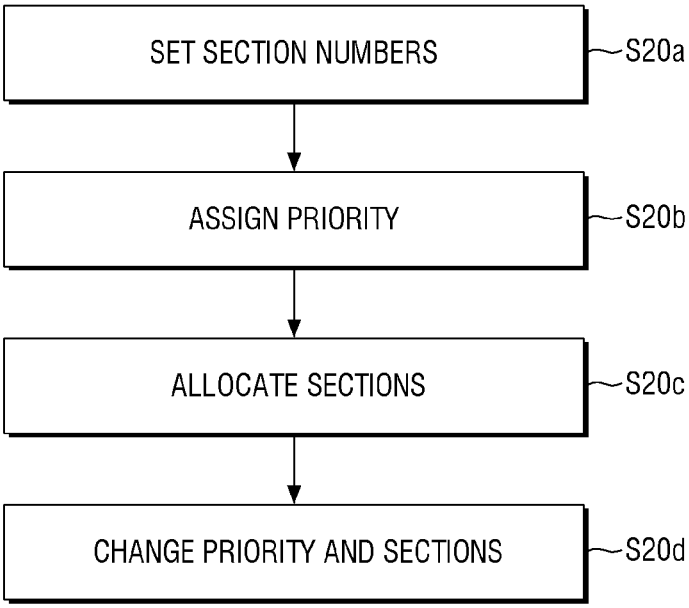
FIG. 10 is a flowchart of setting a section in a multi-armament control method using a single controller according to an embodiment of the present disclosure.

FIG. 7 is a diagram 700 for describing construction of a fixed fire net and a precision strike method in a multi-armament control method using a single controller according to an embodiment of the present disclosure. FIG. 8 is a diagram illustrating variation of a fire net distance according to the moving target 10 in a multi-armament control method using a single controller according to an embodiment of the present disclosure. FIG. 9 is a diagram illustrating a change in a firing net range and a change in the order of sections according to the moving target 10 in a multi-armament control method using a single controller according to an embodiment of the present disclosure. FIG. 10 is a flowchart of setting a section in a multi-armament control method using a single controller according to an embodiment of the present disclosure.

Referring to FIGS. 7 to 10, variable fire nets of the armaments according to an embodiment of the present disclosure may be constructed and a precision strike for the fire nets may be conducted. In the case of the fixed fire nets, the fire nets may be constructed according to the relative positions of the platforms 120. However, in the case of the variable fire nets, the fire nets may be constructed according to sections that are variably set by measuring the location of the target 10 that varies in real time and the relative positions and distances between the target 10 and the platforms 120.

In the method of constructing the variable fire nets of the armaments, the plurality of platforms 120 receiving the information about the target 10 acquired by the operating vehicle 110 may be set the center point of fire for each platform 120 before the initial maneuver. The fire net range may be adjusted by setting an offset value based on the coordinate point of the center of fire of the armament equipped in the operating vehicle 110 operated by the operator. For example, based on coordinates (X0, Y0) of the center of fire 610 of the operating vehicle 110, a wider fire net may be constructed by setting offset values as X1=−10 and Y1=−10 for coordinates of the center of fire 611 of the "SECTION 1". In addition, if X1=0 and Y1=0 are input as the coordinates of the center of fire 611 of the "SECTION 1," it may be possible to conduct a precision strike. Furthermore, the operating vehicle 110 may variably construct the area of the fire net of each platform 120 based on a constant k for the center point of fire of each platform 120. For example, the operating vehicle 110 may obtain the constant k based on an operator of the operating vehicle 110 setting the constant k via an input device (e.g., a button, switch, touchscreen, etc.) of the operating vehicle 110, but embodiments of the present disclosure are not limited thereto.

The fire net range for each section may vary with time according to the moving speed, and expected time, the location of the platform 120 equipped with the armament, etc. according to the movement of the target 10. In addition, a section of an existing platform 120 may be removed or a section of a new platform 120 may be additionally created according to the relative position and distance between the target 10 and the platform 120.

With reference to FIG. 10, the method of setting the section may include setting at least one section number (step S20*a*), assigning priority (step S20*b*), allocating a section (step S20*c*), and changing the section (step S20*d*).

First, section numbers of section of a plurality of platforms are set in order of relative distance from the coordinate point of the center of fire of the operating vehicle 110. (S20*a*).

After the at least one section number is generated, the operating vehicle 110 gives priority to each platform 120 based on the distance of each platform 120 to the target 10 and armed status of each platform 120 with respect to the target when the armaments of the platforms 120 are operated (S20*b*).

When assigning priority, the relative position and distance to the target 10 for each platform 120 may be checked and the priority may be assigned based on the relative positions and distances, and/or the effective firing range of the armament equipped in each of the platform 120 may be checked and the priority may be assigned based on the effective firing ranges.

However, when the relative position and distance to the target 10 are out of the effective firing range of the armament equipped in the platform 120, allocation of a section to the platform 120 may be excluded. Also, when a friendly vehicle exists between the platform 120 and the target 10, allocation of the section to the platform 120 may be excluded.

Based on the assigned priorities as described above, the sections may be respectively allocated to the platforms 120 by assigning the sections, in order of lowest to highest section number, to the platforms 120 in ascending order from highest priority to lowest priority (step S20*c*).

After the sections are allocated, the priority and the sections may be changed in real time based on the location of the target 10 and the location of the platforms 120 (step S20*d*).

In the state in which the sections are set as described above, the fire net range of the armament for each platform 120 may be varied based on the moving speed of the target 10 the velocity of the armament of the platform 120, the order of the sections may be changed in real time. by taking into account the period of each expected time.

For example, with reference to FIGS. 8-9, the sections of the plurality of platforms 120 are set through the relative position and distance between the target 10 and each platform 120. The numbered sections are set to assign priority to each platform 120 in the order from the shortest relative distance to the center of fire of the operating vehicle 110 to the longest relative distance. Thereafter, the sections may be allocated in the order of, for example, section numbers from 1 to 7 to the platforms 120 from the highest priority to the lowest priority based on, for example, the relative position and distance to the target 10 and the effective firing range of each platform 120.

Therefore, at initial time T1, the sections may be allocated to the platforms 120 in the order of section numbers from 1 to 7. At time T2, after a predetermined time elapses from time T1, the priority of the platforms 120 may be changed according to the moving speed of the target 10. In addition, when the target 10 is out of the effective firing range of a platform 120 (e.g., that has been allocated a section having the section number "3") or a friendly vehicle exists on a straight line from the platform 120 (e.g., that has been allocated the section having the section number "3") to the target 10 as the relative distance from the armament is changed according to the movement of the target 10, the allocation of a section (e.g., the section having the section number "3") may be excluded so that the priority of the numbered sections may be changed at time T2 in the order of 1, 2, 4, 7, and 5.

Also, at a time T3 after a predetermined time elapses from T2, the priority of the platforms 120 (and the corresponding sections) may be changed according to the moving speed of the target 10. In addition, when the target 10 is out of the effective firing range or a friendly vehicle exists on the straight line to the target 10 as the relative distance from the armament according to the movement of the target 10, the allocation of the sections may be changed and/or excluded so that the priority of the sections may be changed at time T3 in the order of 1, 4, 2, 5, 7, and 6.

Furthermore, the net fire range may also vary at time T1, time T2, and time T3 depending on the muzzle velocity of the armament (e.g., cannon) of each platform 120.

As described above, in operating multiple armaments using a single controller, the real-time performance in driving and firing of all armaments and the construction of fire nets may be achieved.

Many modifications and other embodiments of the present disclosure will come to the mind of one skilled in the art having the benefit of the teachings presented in the foregoing descriptions and the associated drawings. Therefore, it is understood that embodiments of the present disclosure are not to be limited to the specific example embodiments described herein, and that modifications and other embodiments are intended to be included within the scope of the present disclosure.

The multi-armament control system using a single controller and method thereof according to an embodiment of the present disclosure allow one operator to control the operation of arms in multiple unmanned platforms (e.g., vehicles) having different fire networks through a single manipulator.

In addition, The multi-armament control system using a single controller and method thereof according to an embodiment of the present disclosure determines the distance and order of fire networks aiming at the same directing point in real time in multiple weapons having different fire networks, and prioritizes each range. Embodiments of the present disclosure provide an advantage in that the accuracy of targeting by a plurality of unmanned platforms can be increased by determining.

Furthermore, the multi-armament control system using a single controller and method thereof according to an embodiment of the present disclosure has the advantage of being able to control aiming of a plurality of unmanned platforms at the same direction of the target by controlling the interval and order of the meshes corresponding to each armament in multiple armaments having different fire networks and ranges when controlling a plurality of vehicles with different armaments through the single controller.

The effects of embodiments of the present disclosure are not limited to the above-described effects and other effects which are not described herein will become apparent to those skilled in the art from the above description.

What is claimed:

1. A multi-armament control system comprising:

a plurality of platforms, each of the plurality of platforms comprising an armament; and an operating vehicle configured to operate the plurality of platforms based on a single controller of the operating vehicle, wherein the operating vehicle is further configured to:

acquire information about a target according to presence or absence of the target, generate a position of a directing point of the target, and share the position of the directing point of the target with the plurality of platforms, wherein each of the plurality of platforms is configured to receive the position of the directing point, wherein at least one from among the operating vehicle and the plurality of platforms is configured to construct fixed fire nets or variable fire nets of the plurality of platforms according to whether the target moves, and wherein the at least one from among the operating vehicle and the plurality of platforms is configured to construct the fixed fire nets or the variable fire nets by, in part, assigning priority, to each of the plurality of platforms based on the target and a firing range of the armament of the plurality of platforms.

2. The multi-armament control system of claim 1, wherein the at least one from among the operating vehicle and the plurality of platforms is configured to construct the variable fire nets of the plurality of platforms by:

allocating, to the plurality of platforms, sections in an order from a shortest relative distance from a coordinate point of a center of fire of an armament of the operating vehicle to a longest relative distance from the coordinate point of the center of fire of the armament of the operating vehicle;

setting a center point of fire for each section;

adjusting a fire net range by setting an offset value based on the coordinate point of the center of fire of the armament of the operating vehicle; and varying the fire net range for each section with time according to a moving speed of the plurality of platforms, a time period, relative positions of the plurality of platforms with respect to the target, and movement of the target.

3. The multi-armament control system of claim 2, wherein the at least one from among the operating vehicle and the plurality of platforms is configured to:

assign the priority to each of the plurality of platforms based on a distance and an armed status of each of the plurality of platforms;

allocate the sections to the plurality of platforms based on the priority; and change an order of the sections in real time by taking into account a period of each expected time when a fire net range of the armament of each of the plurality of platforms is varied based on the moving speed of the target and a velocity of the armament of the plurality of platforms.

4. The multi-armament control system of claim 3, wherein the at least one from among the operating vehicle and the plurality of platforms is configured to:

based on a relative position and a distance to the target being out of an effective firing range of the armament of one of the plurality of platforms, not allocating any of the sections to the one of the plurality of platforms; and based on a friendly vehicle existing between the one of the plurality of platforms and the target, not allocating any of the sections to the one of the plurality of platforms.

5. The multi-armament control system of claim 1, wherein the at least one from among the operating vehicle and the plurality of platforms is configured to construct the fixed fire nets by setting a center point of fire for each of the plurality of platforms and adjust a fire net range by setting an offset value based on a coordinate point of a center of fire of an armament of the operating vehicle.

6. The multi-armament control system of claim 1, wherein the operating vehicle is further configured to:

based on determining that the target is present, obtain a relative distance to the target and check a shootable range by using a distance detector;

based on determining that the target is absent, obtain the relative distance by temporarily setting a maximum firing range of an armament of the operating vehicle as the relative distance; and obtain the position of the directing point of the target based on the relative distance.

7. The multi-armament control system of claim 1, wherein the plurality of platforms are configured to:

calculate a distance and a relative position between the armament of the plurality of platforms and the directing point based on posture information and location information about each vehicle equipped with the armament and the directing point received from the operating vehicle; and calculate a target coordinate point of each armament based on a coordinate point preset.

8. The multi-armament control system of claim 1, wherein the at least one from among the operating vehicle and the plurality of platforms is configured to:

determine fire net ranges and a firing order of the armament of the plurality of platforms in real time;

assign the priority to the plurality of platforms in an order of a firing range of the armament of the plurality of platforms, based on a distance to the target obtained by the operating vehicle; and based on a friendly vehicle existing on a straight line to the target from one of the plurality of platforms, assign a lower priority or not assigning any priority to the one of the plurality of platforms.

9. A multi-armament control method, comprising:

controlling, by a single controller of an operating vehicle, armaments of a plurality of platforms;

acquiring, by the operating vehicle, information about a target;

receiving, by each platform from among the plurality of platforms, the information about the target acquired by the operating vehicle;

constructing, by at least one from among the operating vehicle and the plurality of platforms, fire nets of the armaments of the plurality of platforms; and determining, by the at least one from among the operating vehicle and the plurality of platforms, in real time, fire net ranges and a firing order of the armaments based on the fire nets of the armaments by taking into account whether the target moves.

10. The multi-armament control method of claim 9, wherein the constructing comprises:

constructing variable fire nets of the armaments by setting a center point of fire for a plurality of sections; and adjusting a fire net range by setting an offset value based on a coordinate point of a center of fire of an armament of the operating vehicle.

11. The multi-armament control method of claim 10, wherein the constructing the variable fire nets comprises varying a fire net range for each section with time according to a moving speed of the plurality of platforms, a time period, relative positions of the plurality of platforms with respect to the target, and movement of the target.

12. The multi-armament control method of claim 10, further comprising, by the at least one from among the operating vehicle and the plurality of platforms:

setting the sections to the plurality of platforms based on measuring a relative position and a distance between the target and each of the plurality of platforms; and removing a section previously set to one of the plurality of platforms or creating an additional section to be set to one of the plurality of platforms, that has not been associated with any of the sections, based on the relative position and the distance between the target and each of the plurality of platforms.

13. The multi-armament control method of claim 12, wherein the setting of the sections comprises:

setting section numbers to the sections in an order from one of the sections having a shortest relative distance to the coordinate point of the center of fire of the operating vehicle to another one of the sections having a longest relative distance to the coordinate point of the center of fire of the operating vehicle;

assigning a priority to each of the plurality of platforms based on a distance and an armed status of each of the plurality of platforms;

allocating the sections to the plurality of platforms based on the priority; and changing in real time the priority and the sections based on a location of the target and a location of each of the plurality of platforms.

14. The multi-armament control method of claim 13, wherein the assigning the priority comprises:

checking the relative position and the distance to the target of each of the plurality of platforms;

checking an effective firing range of the armaments of the plurality of platforms, not allocating any of the sections to one of the plurality of platforms based on determining that the relative position and the distance of the one of the plurality of platforms to the target are out of an effective firing range of the armament of the one of the plurality of platforms or based on determining that a friendly vehicle exists between the one of the plurality of platforms and the target.

15. The multi-armament control method of claim 13, wherein the changing comprises changing an order of the sections in real time by taking into account a period of each expected time when a fire net range of the armaments of each of the plurality of platforms is varied based on a moving speed of the target and a velocity of the armaments of the plurality of platforms.

16. The multi-armament control method of claim 9, wherein the constructing comprises:

constructing fixed fire nets of the armaments by adjusting a center point of fire and a fire net range for each of the plurality of platforms by setting an offset value based on a coordinate point of a center of fire of an armament of the operating vehicle.

17. The multi-armament control method of claim 9, wherein the acquiring the information about the target comprises:

acquiring posture/location information about the operating vehicle and armament position information;

determining presence or absence of the target;

acquiring a relative distance to the target according to the presence or absence of the target;

generating a position of a directing point based on the relative distance; and sharing at least the position of the directing point with the plurality of platforms.

18. The multi-armament control method of claim 9, wherein the acquiring the information about the target further comprises:

based on determining that the target is present, obtaining a relative distance to the target and checking a shootable range by using a distance detector; or based on determining that the target is absent, obtaining the relative distance by temporarily setting a maximum firing range of an armament of the operating vehicle as the relative distance.

19. The multi-armament control method of claim 18, wherein the constructing the fire nets comprises:

receiving a position of a directing point from the operating vehicle;

acquiring posture information and location information about each of the plurality of platforms;

calculating a distance and a relative position to the directing point; and calculating a target coordinate point of each of the armaments based on a coordinate point preset.

20. The multi-armament control method of claim 9, wherein the determining comprises:

assigning a priority to each of the plurality of platforms in an order of a firing range of the armaments of the plurality of platforms; and based on a friendly vehicle existing on a straight line to the target from one of the plurality of platforms, assigning a lower priority to the one of the plurality of platforms.

* * * * *